US009162521B2

(12) United States Patent
Dietrich

(10) Patent No.: US 9,162,521 B2
(45) Date of Patent: Oct. 20, 2015

(54) PAINTING CARRIER WITH MULTIPLE WIDTH TRACKS

(71) Applicant: RAYMAR ART, INC., Phoenix, AZ (US)

(72) Inventor: Cathy A. Dietrich, Phoenix, AZ (US)

(73) Assignee: Raymar Art, Inc., Phoenix, AZ (US)

( * ) Notice: Subject to any disclaimer, the term of this patent is extended or adjusted under 35 U.S.C. 154(b) by 380 days.

(21) Appl. No.: 13/875,485

(22) Filed: May 2, 2013

(65) Prior Publication Data

US 2014/0326619 A1 Nov. 6, 2014

(51) Int. Cl.

| | |
|---|---|
| ***B44D 3/00*** | (2006.01) |
| ***B65D 85/62*** | (2006.01) |
| *A45C 11/00* | (2006.01) |
| *A45C 13/02* | (2006.01) |
| *B42F 17/04* | (2006.01) |
| *B42F 17/06* | (2006.01) |

(52) U.S. Cl.

CPC *B44D 3/00* (2013.01); *B65D 85/62* (2013.01); *A45C 11/00* (2013.01); *A45C 2013/026* (2013.01); *B42F 17/04* (2013.01); *B42F 17/06* (2013.01)

(58) Field of Classification Search

CPC .. A45C 11/00; A45C 11/24; A45C 2013/026; B42F 17/04; B42F 17/06; B42F 17/32; B42F 7/02; B42F 7/06; B42F 7/14; B44D 3/00; B44D 3/04; B65D 5/504; B65D 85/62

USPC ..... 206/425

See application file for complete search history.

(56) References Cited

U.S. PATENT DOCUMENTS

| | | | |
|---|---|---|---|
| 2,648,933 | A | 8/1953 | Brooks et al. |
| 2,976,985 | A | 3/1961 | Kraus |
| 4,471,869 | A | 9/1984 | Hasenfus |
| 2004/0232025 | A1 | 11/2004 | Lunde |

OTHER PUBLICATIONS

RayMar Art, "Wet Painting Carriers", Internet web page first published prior to Apr. 2012, www.raymarart.com.

(Continued)

*Primary Examiner* — Anthony Stashick
*Assistant Examiner* — Mollie Llewellyn
(74) *Attorney, Agent, or Firm* — Cahill Glazer PLC

(57) ABSTRACT

A carrier for painting panels includes a box-like container including first and second opposing side walls, front and rear walls, and a floor closing the lower end of the container. A stepped track extends along each of the side walls, each stepped track including at least first and second channels for engaging first edges of first and second panels, respectively. The first and second channels are spaced from the corresponding side wall by first and second distances, respectively. The second distance exceeds the first distance by at least 0.25 inch, and preferably by 0.50 inch or by 1.0 inch. Preferably, each stepped track includes a third channel for engaging an edge of a third panel; the third channel is spaced from the corresponding side wall by a third distance which exceeds the second distance by at least 0.25 inch, preferably by 0.50 inch or by 1.0 inch.

14 Claims, 4 Drawing Sheets

(56) References Cited

OTHER PUBLICATIONS

Guerrilla Painter Wet Painting Tote, Internet web page first published prior to Apr. 2012, www.judsonart.com.

SourceTek, "Gator Box" wet panel carrier and storage box, Internet web page first published prior to Apr. 2012, www. canvaspanels.com.

RayMar Art, "Small Wet Panel Carrier Adaptor", Internet web page first published before Apr. 2012, www.raymarad.com.

PAINTING CARRIER WITH MULTIPLE WIDTH TRACKS

BACKGROUND OF THE INVENTION

1. Field of the Invention

The present invention relates generally to apparatus for transporting painting panels, and more particularly, to a painting carrier that accommodates a variety of painting panels of differing sizes and dimensions.

2. Description of the Relevant Art

Many artists enjoy painting outdoor scenes. This usually requires that the painter bring a portable easel, one or more painting panels, paints, brushes, an easel, and other supplies to a remote area having scenery of interest. As used herein, the term painting panels is intended to refer to a variety of panels on which artists create paintings, including canvas panels, linen panels, plain aluminum panels, oil painting paper mounted on a backing-board, plain wood panels, and the like. When the painting session is complete, or as the day ends, the painter desires to store and protect the painted panels. The paint takes time to dry and harden, and it is important to protect the painted panels from moisture, as well as from physical contact that would smear the paint. These same considerations apply even when an artist is painting indoors, e.g., at an art class; it is still necessary for the artist to transport the paintings between home and the art class, often before such paintings are entirely dry.

Painting carriers have been commercially available for quite some time for such purpose. The present applicant has previously developed lightweight wet painting carriers sold under the trademark "RayMar Art" by RayMar Art of Phoenix, Ariz. for carrying and protecting painting panels. Divided tracks, or channels, are provided along each side of the carrier, and a wet panel can be slid inside each track. The tracks support each panel by its edges and prevent one panel from contacting another panel; the tracks also prevent the frontmost panel from contacting the front of the carrier, and prevent the rearmost panel from contacting the rear of the carrier. A wet panel painting carrier is also available from SourceTek of Scottsdale, Ariz. under the trade designation "GatorBox". Another type of wet panel carrier is commercially available from Judson's Art Outfitters of LaPorte, Colo. under the trade designation "Guerilla Painter".

Painting panels are available in a large variety of sizes. For example, standard painting panel sizes include:

| |
|---|
| 5 inch by 7 inch |
| 6 inch by 8 inch |
| 8 inch by 10 inch |
| 9 inch by 12 inch |
| 10 inch by 12 inch |
| 11 inch by 14 inch |
| 12 inch by 16 inch |
| 16 inch by 20 inch |
| 18 inch by 24 inch. |

Often artists will order custom panels cut in square shapes, e.g., 12 inch by 12 inch.

All wet painting carriers known to the applicant are made initially to accommodate panels of a fixed width (or length, if the painting is turned sideways). Each painting carrier typically has opposing tracks extending along the inner sidewalls of the carrier, and the spacing between such opposing tracks is fixed for a given carrier. It is sometimes possible to simultaneously carry two non-identical painting panels in the same carrier by rotating one of the panels ninety-degrees relative to the other. For example, when using a carrier having an internal width of approximately ten inches, an artist may be able to carry an 8-inch by 10-inch panel, as well as a 10-inch by 12-inch panel, as by inserting each panel into the carrier so that its ten-inch dimension spans the width of the carrier. Clearly, this technique would not work if an artist wanted to carry both an 8-inch by 10-inch panel and a 9-inch by 12-inch panel at the same time, within the same carrier.

In view of the relatively large number of painting panel sizes, suppliers of wet painting carriers must typically offer a number of different sized wet panel carriers for their customers. In turn, artists who paint on varying sized painting panels often need to purchase several different wet sized carriers to transport and protect different-sized painting panels. This is not only expensive for artists, but it is also inconvenient, as an artist is often required to bring two or three different wet painting carriers along with them for a given painting session.

Some suppliers of wet panel carriers offer adapters, or inserts, to effectively reduce the width of the tracks already provided in a wet panel carrier. For example, RayMar Art of Phoenix, Ariz., offers an adapter designed to reduce the width of tracks originally provided in its wet panel carriers by one inch. Use of a single adapter with one side wall of the carrier reduces the widths of all the tracks by one inch; use of two adapters, one for each side wall of the carrier, reduces the widths of all the tracks by two inches. Another supplier, SourceTek, apparently offers a conversion accessory, or "Divider Kit", that includes removable inserts that slide into the original tracks to reduce the effective width of the tracks. However, such conversion kits merely change the original fixed width spacing between all of the opposing tracks from one distance to a smaller distance. None of the available wet painting carriers known to applicant simultaneously accommodate two or more painting panels of different sizes, and lacking at least one dimension in common, at the same time.

Accordingly, it is an object of the present invention to provide a painting carrier to protect and transport two or more painting panels of different sizes at the same time, even when such painting panels do not share at least one dimension in common.

A further object of the present invention is to provide such a painting carrier which is easy and inexpensive to construct.

Still another object of the present invention is to provide such a painting carrier that can accommodate a wide variety of painting panel sizes all at the same time.

These and other objects of the invention will become more apparent to those skilled in the art as the description of the present invention proceeds.

SUMMARY OF THE INVENTION

Briefly described, and in accordance with a preferred embodiment thereof, the present invention relates to a painting carrier for carrying two or more painting panels of different dimensions even when they lack a dimension in common. The improved carrier includes first and second opposing side walls spaced apart from each other. Each side wall has opposing forward and rear edges. A front wall of the container extends between the forward edges of the first and second side walls, while a rear wall of the container extends between the rear edges of the first and second side walls. A floor, or bottom wall, is coupled to the lower ends of the side walls, front wall, and rear wall to close off the bottom end of the container.

A first stepped track is mounted to extend along the first side wall. This first stepped track includes a first channel for engaging a first edge of a first panel, and a second channel for engaging a first edge of a second panel. Likewise, a second stepped track is mounted to extend along the second side wall. This second stepped track includes a first channel for engaging a second opposing edge of the first panel, and a second channel for engaging the second opposing edge of the second panel.

In the preferred embodiment, the first channel of the first stepped track is spaced from the first side wall by a first distance, while the second channel of the first stepped track is spaced from the first side wall by a second distance. Preferably, the second distance exceeds the first distance by at least 0.25 inch. Similarly, in the preferred embodiment, the first channel of the second stepped track is spaced from the second side wall by the first distance and the second channel of the second stepped track is spaced from the second side wall by the second distance.

In one preferred embodiment, the second distance exceeds the first distance by approximately 0.50 inch; the result is that the separation distance between the first channels in the first and second stepped tracks will be approximately one inch greater than the separation distance between the second channels in the first and second stepped tracks.

In a second preferred embodiment, the second distance exceeds the first distance by approximately 1.0 inch; the result is that the separation distance between the first channels in the first and second stepped tracks will be approximately two inches greater than the separation distance between the second channels in the first and second stepped tracks.

The first and second stepped tracks are preferably made of plastic, and may be formed by injection molding or by extrusion. One preferred technique for mounting the first and second stepped tracks within the carrier is the use of an adhesive to secure each stepped track to its corresponding side wall. Alternatively, the first and second stepped tracks can be secured within the carrier by screws, rivets, or the like.

In the preferred embodiment, the first and second stepped tracks each include a third channel for engaging opposing edges of a third panel. The third channel of each stepped track is spaced from its corresponding side wall by a third distance, the third distance exceeding the second distance by at least 0.25 inch. In one preferred embodiment, the third distance exceeds the second distance by approximately 0.50 inch; the result is that the separation distance between the third channels in the first and second stepped tracks will be approximately one inch smaller than the separation distance between the second channels in the first and second stepped tracks. In a second preferred embodiment, the third distance exceeds the second distance by approximately 1.0 inch; the result is that the separation distance between the third channels in the first and second stepped tracks will be approximately two inches smaller than the separation distance between the second channels in the first and second stepped tracks.

The summary of the invention set forth above presumes that the side walls of the carrier are generally parallel to each other and perpendicular to the front and rear walls of the carrier, as is true for existing carriers known to applicant. However, the invention can also be summarized by describing the distance between the respective channels in the first and second stepped tracks, rather than by reciting the distance of each channel from its associated side wall. As before, the painting carrier includes a container having first and second opposing side walls spaced apart from each other. A front wall extends between the forward edges of the first and second side walls, a rear wall of the container extends between the rear edges of the first and second side walls, and a floor forming the bottom of the container.

A first stepped track extends along the first side wall, and includes a first channel for engaging a first edge of a first panel, and a second channel for engaging a first edge of a second panel. A second stepped track extends along the second side wall, and likewise includes a first channel for engaging the opposing edge of the first panel, and a second channel for engaging the opposing edge of the second panel. The first channel of the second stepped track is spaced from the first channel of the first stepped track by a first spacing, and the second channel of the second stepped track is spaced from the second channel of the first stepped track by a second spacing. The first spacing exceeds the second spacing by at least 0.50 inch. In one preferred embodiment, the first spacing exceeds the second spacing by approximately one inch. In a second preferred embodiment, the first spacing exceeds the second spacing by approximately two inches.

In the preferred embodiments, the first and second stepped tracks each includes a third channel for engaging opposing edges of a third panel. The third channel of the second stepped track is spaced from the third channel of the first stepped track by a third spacing, and the second spacing exceeds the third spacing by at least 0.50 inch. In one preferred embodiment, the first spacing exceeds the second spacing by approximately one inch, and the second spacing exceeds the third spacing by approximately one inch. In an alternate embodiment, the first spacing exceeds the second spacing by approximately two inches, and the second spacing exceeds the third spacing by approximately two inches.

DETAILED DESCRIPTION OF THE PREFERRED EMBODIMENTS

Figure 1:
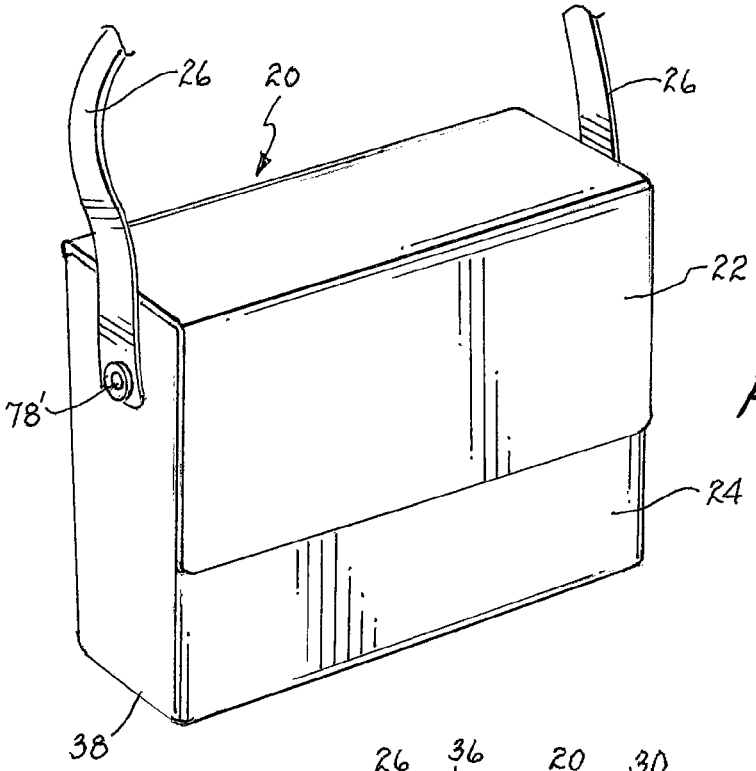
FIG. 1 is a perspective view of a painting carrier wherein a cover flap is secured over the upper end of the carrier.
Figure 4:
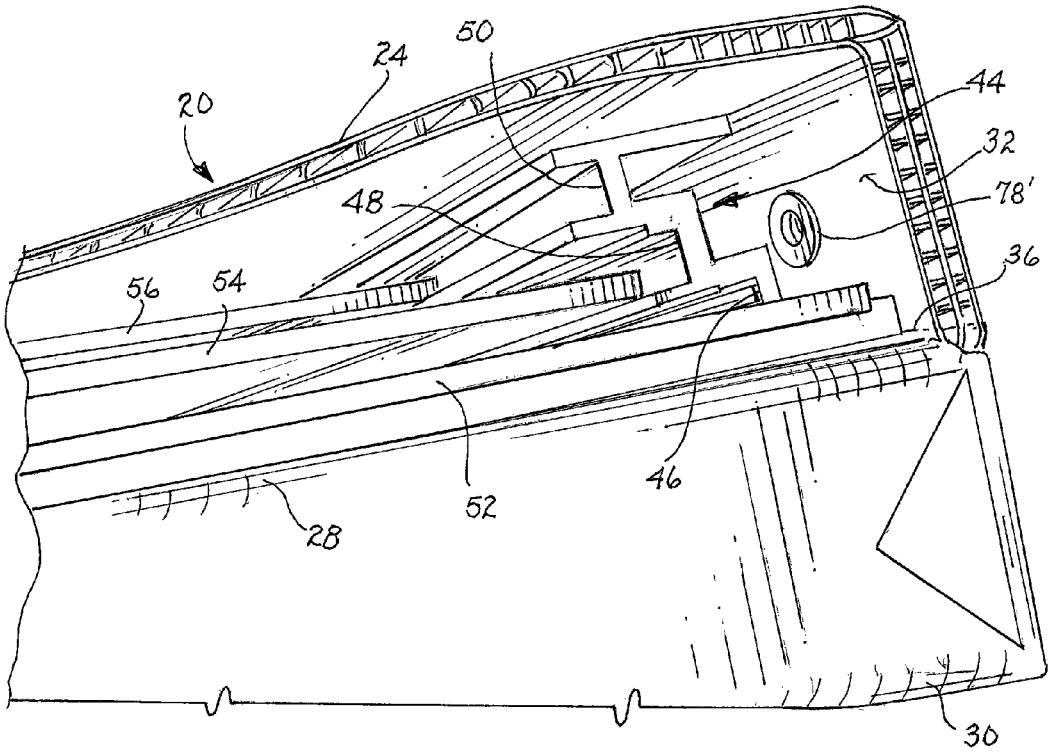
FIG. 4 is a partial perspective view of one the stepped tracks shown in FIG. 3.

A preferred form of painting carrier for carrying a plurality of painting panels, in accordance with the teachings of the present invention, is designated generally in FIG. 1 by reference numeral 20. Cover flap 22 is secured over the upper end of carrier 20, and extends partially over front wall 24 of the carrier; cover flap 22 is preferably hingedly connected to the upper end of the rear wall of carrier 20. A shoulder strap 26 is secured to the exterior surface of each side wall of carrier 20 for allowing a user to support carrier 26 from the user's shoulder during transport. Referring briefly to FIG. 4, plastic rivets 78/78' pass through the opposing ends of shoulder strap 26, and through side walls 34 and 32, respectively, to secure the ends of shoulder strap 26 to the upper ends of side walls 34 and 32.

Figure 2:
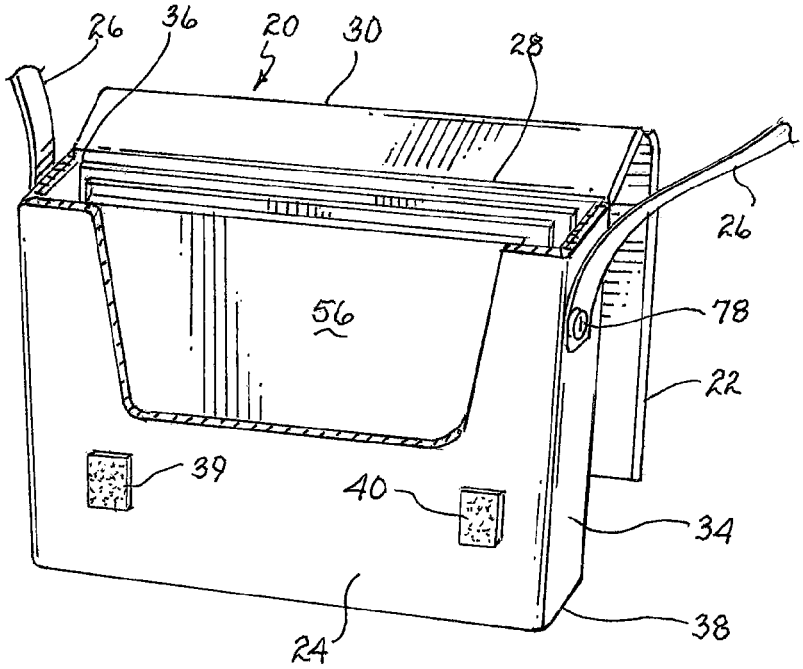
FIG. 2 is a perspective view of the painting carrier with the cover flap folded back to reveal the painting panels stored inside.
Figure 3:
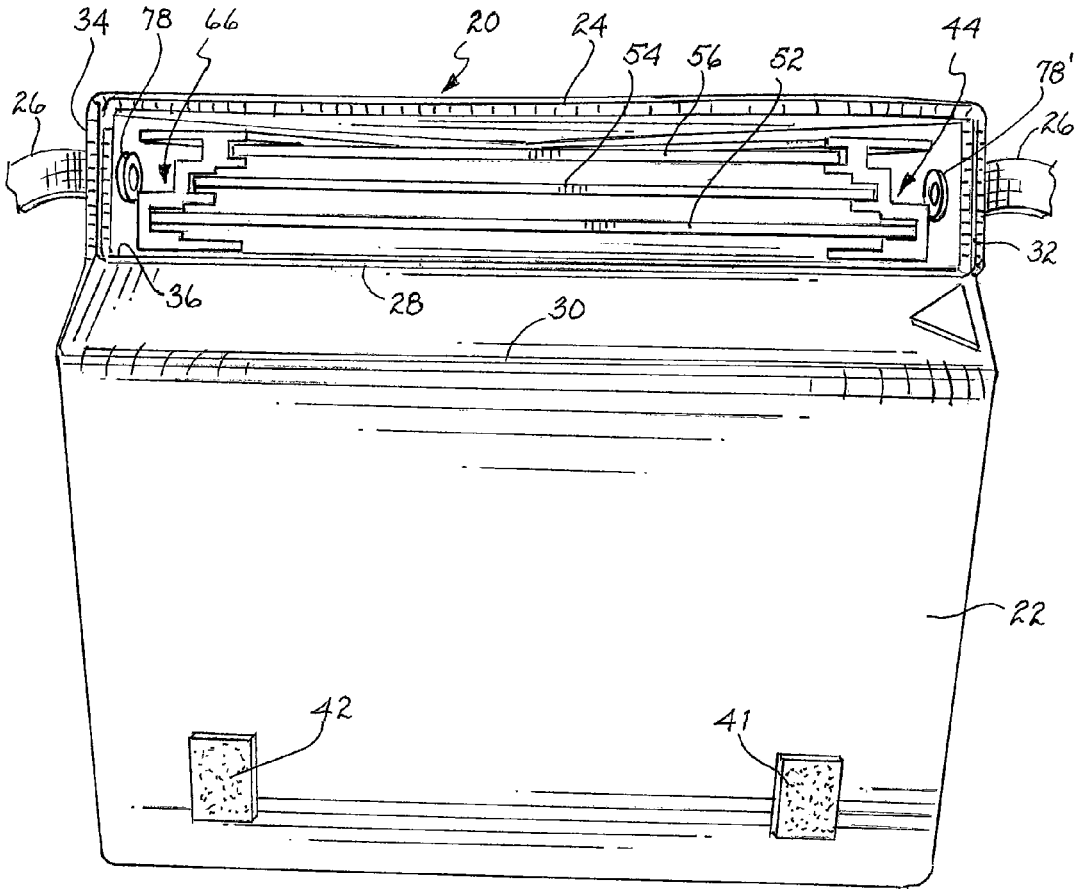
FIG. 3 is a top view of the opened painting carrier showing three painting panels supported by stepped tracks mounted inside the carrier.

In FIGS. 2 and 3, carrier 20 is shown with cover flap 22 folded back. Cover flap 22 is coupled to the upper end of the rear wall of carrier 20 along hinge lines 28 and 30. Painting carrier 20 forms a container that includes first and second opposing side walls 32 and 34 that are spaced apart from each other. Front wall 24 extends between the forward edges of side walls 32 and 34. Rear wall 36 of carrier 20 extends between the rear edges of side walls 32 and 34. Floor 38 is coupled to the lowermost ends of side walls 32 and 34, and to the lowermost ends of front wall 24 and rear wall 36, to close the bottom of carrier 20. Preferably, the walls of the carrier are formed from plastic corrugated material similar to that available under the registered trademark "COROPLAST" from Coroplast of Chicago, Ill. As shown in FIG. 2, releasable attachment pads 39 and 40 are secured to the exterior of front wall 24; mating attachment pads 41 and 42 (see FIG. 3) are secured to the interior surface of cover flap 22 in alignment with attachment pads 39 and 40, respectively. These attachment pads may be formed of mating hook-and-loop fabric of the type commercially available under the trademark "VELCRO". These attachment pads releasably attach cover flap 22 over the top of carrier 20 for transport, as shown in FIG. 1.

Figure 5:
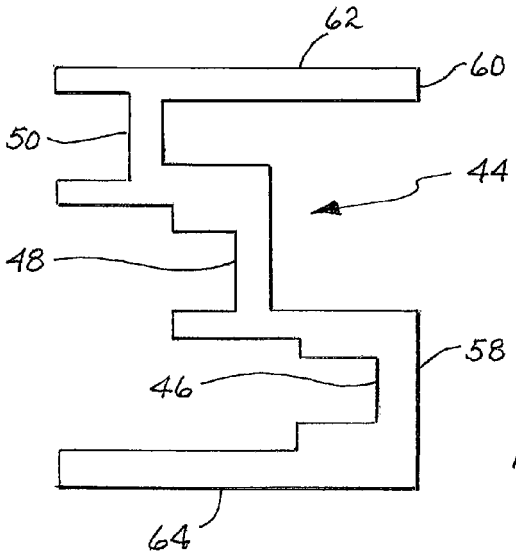
FIG. 5 is a cross-sectional view of the stepped track shown in FIG. 4.

Referring to FIGS. 3-5 and 7, a first stepped track 44 extends along side wall 32. First stepped track 44 includes a first channel 46, a second channel 48, and a third channel 50. First channel 46 is adapted to engage a first edge of a first painting panel 52. Second channel 48 is adapted to engage a first edge of a second painting panel 54. Third channel 50 is likewise adapted to engage a first edge of a third painting panel 56. FIG. 5 shows a detailed cross-section of a preferred embodiment of first stepped track 44. In FIG. 5, the support surfaces 58 and 60 are adapted to engage the interior surface of side wall 32. Support surface 62 is adapted to engage the interior surface of front wall 24, and support surface 64 is adapted to engage the interior surface of rear wall 36.

A second stepped track 66 is provided along opposing side wall 34 and, in the preferred embodiment, is a mirror image of first stepped track 44. Second stepped track 66 similarly includes a first channel 68, a second channel 70, and a third channel 72. First channel 68 is adapted to engage a second opposing edge of first painting panel 52. Second channel 70 is adapted to engage a second opposing edge of second painting panel 54, and third channel 72 is likewise adapted to engage a second opposing edge of third painting panel 56.

Still referring to FIGS. 3-5 and 7, first channel 46 of first stepped track 44 is spaced from first side wall 32 by a first distance. Referring to FIG. 5, this first distance corresponds approximately to the distance between first channel 46 and support surface 58. Second channel 48 of first stepped track is spaced from side wall 32 by a second distance. With reference to FIG. 5, this second distance corresponds approximately to the distance between second channel 48 and a line connecting support surfaces 58 and 60. Third channel 50 of first stepped track 44 is spaced from side wall 32 by a third distance; in regard to FIG. 5, this third distance corresponds approximately to the distance between third channel 50 and support surface 60. Preferably, the second distance exceeds the first distance by at least 0.25 inch. It is also preferred that the third distance exceeds the second distance by at least 0.25 inch.

In regard to the second stepped track 66, channels 68, 70 and 72 are preferably spaced from second side wall 34 by the same first, second and third distances applicable to channels 46, 48, and 50 and to provide a symmetrical structure.

Figure 7:
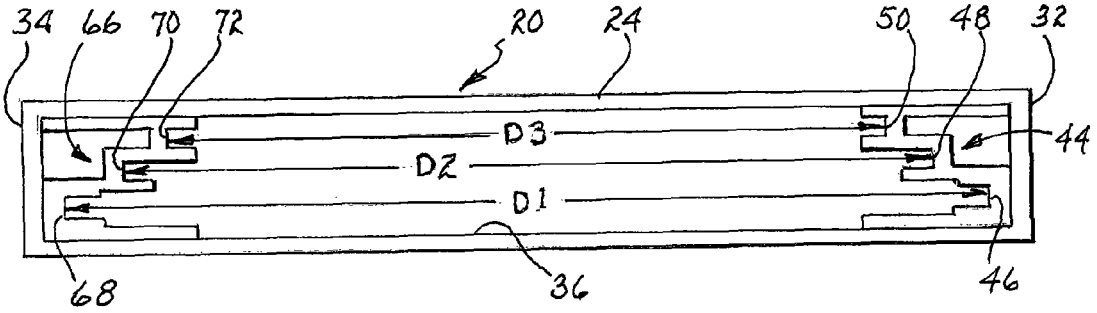
FIG. 7 is a schematic view of the interior of the painting carrier shown in FIG. 3 and illustrating the relative spacing between the respective channels of the first and second stepped tracks.

In a first preferred embodiment, the second distance (i.e., the distance by which second channels 48 and 70 are spaced from side walls 32 and 34, respectively) exceeds the first distance (i.e., the distance by which first channels 46 and 68 are spaced from side walls 32 and 34, respectively) by approximately 0.50 inch, and the third distance exceeds the second distance by approximately 0.50 inch. Referring briefly to FIG. 7, this provides the result that the first spacing D1 between the first channels 46 and 68 is approximately one inch greater than the second spacing D2 between the second channels 48 and 70. Similarly, in this example, the second spacing D2 between the second channels 48 and 70 is approximately one inch greater than the third spacing D3 between the third channels 50 and 72.

Thus, if first spacing D1 is 10 inches, second spacing D2 is 9 inches, and third spacing D3 is 8 inches, then painting carrier 20 could simultaneously receive and store three painting panels of the following varieties:

a) 6"×8"; 8"×10"; and 9"×12";
b) 8"×10"; 9"×12"; and 10"×12";
c) 6"×8"; 9"×12"; and 10"×12";
d) two 8"×10" panels, plus a 9"×12" panel;

and so forth.

In a second example, if first spacing D1 is 12 inches, second spacing D2 is 11 inches, and third spacing D3 is 10 inches, then painting carrier 20 could simultaneously receive and store three painting panels of several varieties, including:

a) a 10"×12" panel, an 11"×14" panel, and a 12"×16" panel;
b) an 8"×10" panel, an 11"×14" panel, and a 12"×16" panel;
c) an 8"×10" panel, an 11"×14" panel, and a 10"×12" panel;
d) an 8"×10" panel, an 11"×14" panel, and a 9"×12" panel;

and so forth.

In a second preferred embodiment, the second distance (i.e., the distance by which second channels 48 and 70 are spaced from side walls 32 and 34, respectively) exceeds the first distance
(i.e., the distance by which first channels 46 and 68 are spaced from side walls 32 and 34, respectively) by approximately one inch, and the third distance also exceeds the second distance by approximately one inch. Referring briefly to FIG. 7, this provides the result that the first spacing D1 between the first channels 46 and 68 is approximately two inches greater than the second spacing D2 between the second channels 48 and 70. Similarly, in this example, the second spacing D2 between the second channels 48 and 70 is approximately two inches greater than the third spacing D3 between the third channels 50 and 72.

Thus, if first spacing D1 is 14 inches, second spacing D2 is 12 inches, and third spacing D3 is 10 inches, then painting carrier 20 could simultaneously receive and store three painting panels of the following varieties:

a) 8"×10"; 9"×12"; and 11"×14";
b) 10"×12"; 9"×12"; and 11"×14";
c) 8"×10"; 12"×16"; and 11"×14";
d) 10"×12"; 12"×16"; and 11"×14";

and so forth.

In the preferred embodiment, each of the first and second stepped tracks is made from plastic material. While initial prototypes were made by injection-molding the plastic material, it is believed that extrusion molding may also be used, and the extruded pieces may then simply be cut to desired lengths. Plastic material is relatively lightweight yet strong enough to adequately separate the painting panels within the carrier. If the first and second stepped tracks 44 and 66 are configured to be mirror images of each other, then the same injection molded piece (or the same extruded piece) may serve as either first stepped track 44 or second stepped track 46; two separate molds are not needed.

Each of the stepped tracks 46/48/50 and 68/70/72 is preferably slightly more than three-eighths of an inch wide. Many painting panels that are commonly sold today are one-eighth inch in thickness. By making each stepped track approximately three-eighths of an inch wide, two already-dried painting panels, each one-eighth inch thick, may easily be stored in each of the three paired channels 46/68, 48/70, and 50/72, thus allowing storage of as many as six painting panels. There are also thicker painting panels commonly sold today having a thickness measuring about three-eighths of an inch. Thus, by making each stepped track just in excess of approximately three-eighths of an inch wide, a three-eighths inch-thick painting panel can be inserted into each of the three paired channels 46/68, 48/70, and 50/72. Obviously, an artist can mix and match panels, e.g., inserting one three-eighths inch thick panel in paired channel 46/68, and one or two (if already dry) one-eighth inch panels in paired channels 48/70 and 50/72.

Figure 6:
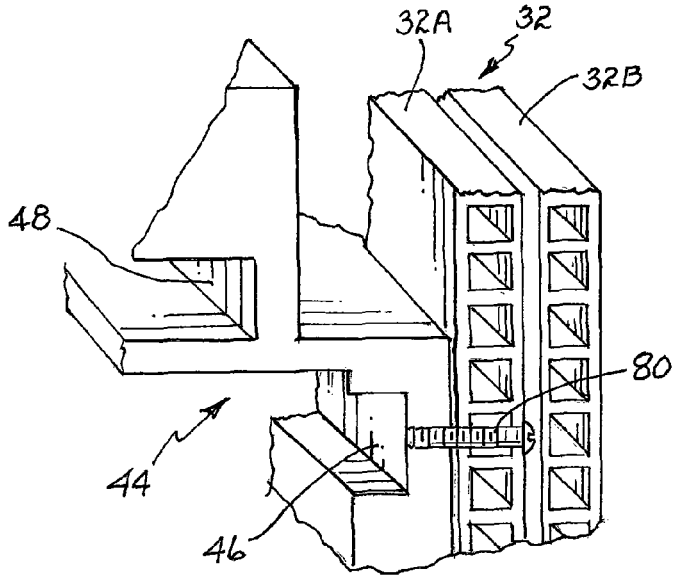
FIG. 6 is a cut-away perspective view illustrating the manner in which a fastener is used to secure a stepped track to a corresponding side wall of the carrier.

First stepped track 44 may be mounted adjacent side wall 32 of carrier 20 in different ways. In one embodiment, adhesive is applied to one or more of surfaces 58, 62 and 64 (see FIG. 5), for attachment to the interior surfaces of side wall 32, front wall 24, and/or rear wall 36, respectively. Alternatively, threaded fasteners, like fastener 80 shown in FIG. 6, may be used to secure first stepped track 44 to side wall 32. As shown in FIG. 6, side wall 32 may be formed of two thicknesses (32A and 32B) of corrugated plastic material for reinforcement. Fastener 80 is inserted through inner thickness 32A and threaded into a hole tapped within first stepped track 44 to hold first stepped track 44 against side wall 32. Outer thickness 32B is then bonded over inner thickness 32A, hiding the head of fastener 80 from view. Those skilled in the art will appreciate that the same mounting technique used to hold first stepped track 44 against side wall 32 may also be used to hold second stepped track 66 against side wall 34.

Those skilled in the art will now appreciate that a simple and inexpensive painting panel carrier has been described for protecting and transporting two or more "wet" painting panels of different sizes at the same time. The novel painting carrier reduces the number of different panel carriers needed by an artist, saving expense, and providing convenience. The painting carrier described above can accommodate two or more painting panels of different sizes, even when they lack even one dimension in common, at the same time. The disclosed panel carrier is relatively easy to construct, and can be manufactured at nominal cost.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A painting carrier for carrying a plurality of painting panels, comprising in combination:

a) a container including:

i. first and second opposing side walls each having opposing forward and rear edges, the first and second opposing side walls being spaced apart from each other;

ii. a front wall extending between the forward edges of the first and second opposing side walls;

iii. a rear wall extending between the rear edges of the first and second opposing side walls; and iv. a floor coupled to a lower end of each of the first and second side walls, to a lower end of the front wall, and to a lower end of the rear wall;

b) a first stepped track extending along the first side wall, the first stepped track including:

i. a first channel for engaging a first edge of a first painting panel, the first channel being spaced from the first side wall by a first distance;

ii. a second channel for engaging a first edge of a second painting panel, the second channel being spaced from the first side wall by a second distance, the second distance exceeding the first distance by at least 0.25 inch; and c) a second stepped track extending along the second side wall, the second stepped track including:

i. a first channel for engaging a second opposing edge of the first painting panel, the first channel of the second stepped track being spaced from the second side wall by the first distance;

ii. a second channel for engaging a second opposing edge of the second painting panel, the second channel of the second stepped track being spaced from the second side wall by the second distance.

2. The painting carrier for carrying a plurality of painting panels as recited by claim 1 wherein the second distance exceeds the first distance by approximately 0.50 inch.

3. The painting carrier for carrying a plurality of painting panels as recited by claim 1 wherein the second distance exceeds the first distance by approximately 1.0 inch.

4. The painting carrier for carrying a plurality of painting panels as recited by claim 1 wherein each of the first and second stepped tracks is made from plastic.

5. The painting carrier for carrying a plurality of painting panels as recited by claim 1 wherein each of the first and second stepped tracks is made from extruded plastic.

6. The painting carrier for carrying a plurality of painting panels as recited by claim 1 wherein each of the first and second stepped tracks is made from injection-molded plastic.

7. The painting carrier for carrying a plurality of painting panels as recited by claim 1 wherein the first stepped track is coupled to the first side wall by an adhesive, and the second stepped track is coupled to the second side wall by an adhesive.

8. The painting carrier for carrying a plurality of painting panels as recited by claim 1 wherein the first stepped track is coupled to the first side wall by at least one fastener, and the second stepped track is coupled to the second side wall by at least one fastener.

9. The painting carrier for carrying a plurality of painting panels as recited by claim 1 wherein:

a) the first stepped track includes a third channel for engaging a first edge of a third painting panel, the third channel being spaced from the first side wall by a third distance, the third distance exceeding the second distance by at least 0.25 inch; and b) the second stepped track includes a third channel for engaging an opposing second edge of the third painting panel, the third channel of the second stepped track being spaced from the second side wall by the third distance.

10. The painting carrier for carrying a plurality of painting panels as recited by claim 9 wherein the second distance exceeds the first distance by approximately 0.50 inch, and wherein the third distance exceeds the second distance by approximately 0.50 inch.

11. The painting carrier for carrying a plurality of painting panels as recited by claim 9 wherein the second distance exceeds the first distance by approximately 1.0 inch, and wherein the third distance exceeds the second distance by approximately 1.0 inch.

12. The painting carrier for carrying a plurality of painting panels as recited by claim 9 wherein each of the first and second stepped tracks is made from plastic.

13. The painting carrier for carrying a plurality of painting panels as recited by claim 9 wherein each of the first and second stepped tracks is made from extruded plastic.

14. The painting carrier for carrying a plurality of painting panels as recited by claim 9 wherein each of the first and second stepped tracks is made from injection-molded plastic.

* * * * *